US011505435B2

(12) United States Patent
Laukkanen et al.

(10) Patent No.: US 11,505,435 B2
(45) Date of Patent: Nov. 22, 2022

(54) TROLLEY OF A CRANE

(71) Applicant: KONECRANES GLOBAL CORPORATION, Hyvinkää (FI)

(72) Inventors: Niko Laukkanen, Hyvinkää (FI); Atte Lähteenmäki, Hyvinkää (FI); Teppo Lindberg, Hyvinkää (FI); Mats Åkesson, Hyvinkää (FI); Henri Helkiö, Hyvinkää (FI); Henri Kokko, Hyvinkää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 435 days.

(21) Appl. No.: 16/649,436

(22) PCT Filed: Sep. 21, 2018

(86) PCT No.: PCT/FI2018/050684
§ 371 (c)(1),
(2) Date: Mar. 20, 2020

(87) PCT Pub. No.: WO2019/058029
PCT Pub. Date: Mar. 28, 2019

(65) Prior Publication Data

US 2020/0283272 A1 Sep. 10, 2020

(30) Foreign Application Priority Data

Sep. 22, 2017 (FI) ..... 20175846

(51) Int. Cl.
*B66C 9/04* (2006.01)
*B66C 11/06* (2006.01)

(52) U.S. Cl.
CPC ..... *B66C 9/04* (2013.01); *B66C 11/06* (2013.01)

(58) Field of Classification Search
CPC .. B66C 9/04; B66C 9/14; B66C 11/04; B66C 11/06; B61B 13/04; B61B 3/00; B66F 11/04
(Continued)

(56) References Cited

U.S. PATENT DOCUMENTS 5,213,045 A * 5/1993 Gersemsky ..... B66C 11/06 104/93
5,303,656 A * 4/1994 Makimura ..... B61C 13/08 104/119
(Continued)

FOREIGN PATENT DOCUMENTS

CN 1212234 A 3/1999
CN 201834680 U 5/2011
(Continued)

OTHER PUBLICATIONS

International Search Report, issued in PCT/FI2018/050684, dated Dec. 3, 2018.
(Continued)

*Primary Examiner* — Zachary L Kuhfuss
(74) *Attorney, Agent, or Firm* — Birch, Stewart, Kolasch & Birch, LLP

(57) ABSTRACT

A trolley of a crane is arranged to move along a main support structure of the crane. The trolley includes a support frame structure; bearing wheels which are fastened to the support frame structure and by means of which the trolley is arranged to move along the main support structure; and a hoisting mechanism that has a rope drum for a hoisting rope, a rope pulley arrangement through which the hoisting rope may be guided from the rope drum to a fixed fastening point on the trolley, and a hoisting member in cooperation with the hoisting rope for hoisting a load. The rope drum is supported to the support frame structure of the trolley so that the axle of the rope drum is parallel to the main support structure.
(Continued)

The rope pulley arrangement is located, in the axial direction of the rope drum, at least partly outside one rope drum end which is on the side of said fastening point. The support frame structure is divided into two separate frame parts, whereby the first frame part supports the rope pulley arrangement and the rope drum end on the side thereof, and whereby the second frame part supports the opposite end of the rope drum. A pivoted joint is arranged between the first frame part and the second frame part, which allows the first and second frame part to move relative to each other around the vertical and horizontal axis and the longitudinal axis of the first and second frame part.

13 Claims, 7 Drawing Sheets

(58) Field of Classification Search
USPC ..... 212/328
See application file for complete search history.

(56) References Cited

U.S. PATENT DOCUMENTS

| | | | | |
|---|---|---|---|---|
| 5,623,879 | A * | 4/1997 | Gersemsky | B61B 3/02 104/93 |
| 10,526,175 | B2 * | 1/2020 | Lindberg | B66D 1/14 |
| 10,597,263 | B2 * | 3/2020 | Zhao | B66C 11/06 |
| 10,961,085 | B2 * | 3/2021 | Lindberg | B66D 1/36 |
| 11,059,703 | B2 * | 7/2021 | Lindberg | B66C 11/06 |
| 2002/0170872 | A1 * | 11/2002 | Kiviniitty | B66C 9/14 212/328 |
| 2005/0092201 | A1 * | 5/2005 | Winter | B66C 9/14 104/96 |
| 2017/0022032 | A1 * | 1/2017 | Lindberg | B66C 11/06 |
| 2017/0029251 | A1 * | 2/2017 | Lindberg | B66D 1/14 |
| 2020/0231414 | A1 * | 7/2020 | Lindberg | B66C 11/02 |

FOREIGN PATENT DOCUMENTS

| | | | | |
|---|---|---|---|---|
| CN | 105939955 | A | 9/2016 | |
| CN | 108675127 | A * | 10/2018 | B66C 7/16 |
| DE | 20010030 | U1 | 11/2000 | |
| GB | 2352709 | B | 3/2003 | |
| JP | 61-68089 | U | 5/1986 | |
| JP | 2006-176240 | A | 7/2006 | |
| KR | 10-0953935 | B1 | 4/2010 | |
| WO | WO 01/46060 | A1 | 6/2001 | |
| WO | WO 2015/110706 | A1 | 7/2015 | |
| WO | WO 2017/168048 | A1 | 10/2017 | |

OTHER PUBLICATIONS

Written Opinion of the International Searching Authority, issued in PCT/FI2018/050684, dated Dec. 3, 2018.
Chinese Office Action and Search Report for Chinese Application No. 201880060592.2, dated Feb. 2, 2021, with English translation of the Office Action.
English Abstract of JP-61-68089-U, published May 9, 1986.

* cited by examiner

TROLLEY OF A CRANE

BACKGROUND OF THE INVENTION

The invention relates to a trolley of a crane, arranged to move along a main support structure of the crane, whereby the trolley comprises a frame structure; bearing wheels which are fastened to the frame structure and by means of which the trolley is arranged to move along said main support structure; a hoisting mechanism that has a rope drum for a hoisting rope, a rope pulley arrangement which has upper and lower rope pulley arrangements and through which the hoisting rope may be guided from the rope drum to a fixed attachment point on the trolley, and a hoisting member in cooperation with the hoisting rope for hoisting a load; whereby the rope drum is supported to the support frame structure of the trolley so that the axle of the rope drum is parallel to the main support structure.

In prior art, there are problems on the distribution of loads on a trolley, caused by the hoisting, whereby the trolley structure is under a heavy local strain, in particular torsional stresses of various kinds. Without major alternation work, the current structures are not suitable for different rope drum lengths or rope pulley arrangements of different widths, whereby the dimension of the upper rope drum arrangement in the axial direction of the rope drum varies. In many of the modern trolleys, the rope drum is usually positioned in the trolley structure or within the frame so that its length may not be changed in a simple manner.

SUMMARY OF THE INVENTION

An object of the invention is to improve the trolley referred to in the beginning so as to enable the aforementioned drawbacks to be solved. This object is achieved with the solution according to the invention, which is characterised in that the rope pulley arrangement is located, in the axial direction of the rope drum, at least partly outside the rope drum end which is on the side of said fastening point; and in that the support frame structure is divided into two separate frame parts, that is, a first frame part and a second frame part, whereby the first frame part supports the rope pulley arrangement and the rope drum end on the side thereof, and whereby the second frame part supports the opposite end of the rope drum. Between the first frame part and the second frame part, a pivoted joint is arranged, which allows the first and second frame part to move relative to each other around the vertical and horizontal axis and the longitudinal axis of the first and second frame part.

Preferred embodiments of the invention are disclosed in the dependent claims.

The invention is specifically based on the fact that when the rope pulley arrangement is arranged in accordance with the invention partly or preferably entirely outside the end of a rope drum, the support frame structure is at the same time divided into two parts, one of which receives the stress caused in particular by the load being hoisted, and the other the load caused by the "free" end of the rope drum. This structure at the same time makes it possible to construct trolleys comprising upper rope pulley arrangements of different sizes and rope drums of different lengths by using the same frame components.

When most of the structure supporting a load has thus been separated from the hoisting mechanism, the structure supporting a load may be standardised independent of the rope drum length/hoisting height choice.

In particular, when the rope pulley arrangement is located, in the axial direction of the rope drum, entirely in front of the rope drum and outside the aforementioned end, the bends in the rope pulley arrangement, causing wear in the hoisting rope, may be avoided.

The pivoted joint between the support frame structure divided into two parts enables the relative movement between the frame parts, improving the run properties of the trolley.

In the solution according to the invention, the structure supporting the trolley is mainly strained by tensile stress whereby a bending torque load is for the largest part avoided, or when the pivoted joint is operating, is almost entirely avoided.

LIST OF FIGURES

The invention will now be described in more detail by means of a few preferred exemplary embodiments, with reference to the attached drawings, in which FIG. 1 is a simplified perspective view of the hoisting mechanism of the inventive trolley;

DETAILED DESCRIPTION OF THE INVENTION

Figure 1:
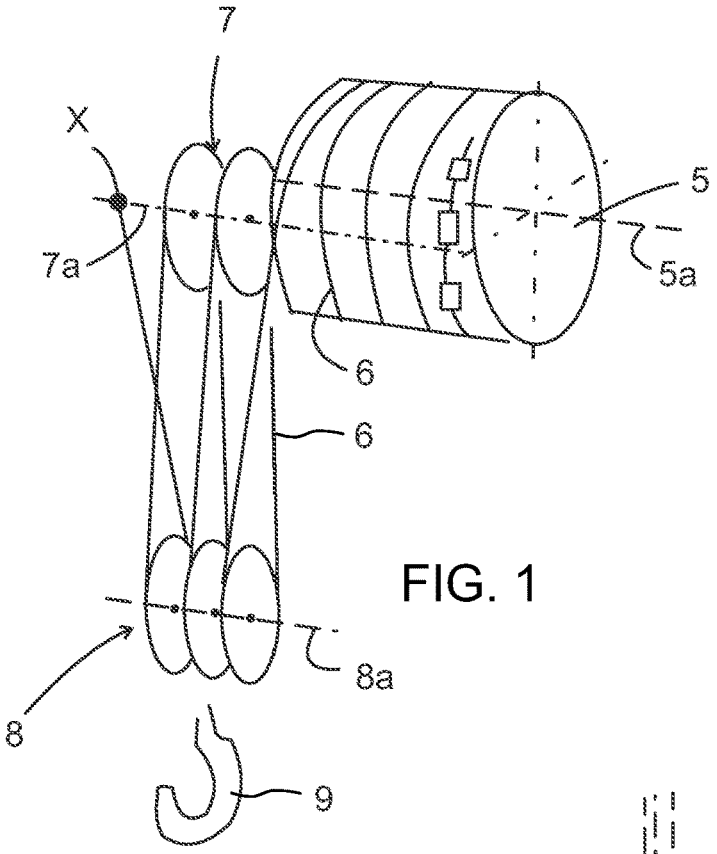
Figure 2:
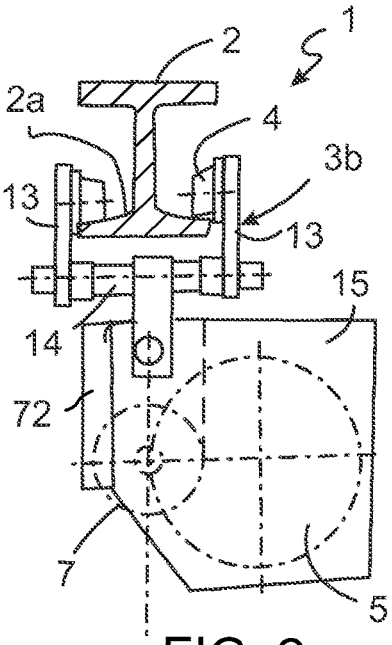
FIG. 2 is a perspective view of an inventive trolley seen from the direction of the main support.
Figure 3:
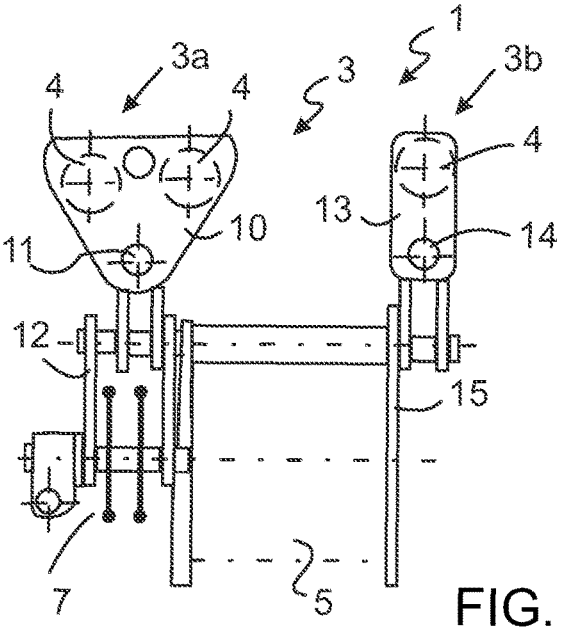
FIG. 3 is a side view of the trolley according to FIG. 2.

Referring at first to FIGS. 1 to 3, a trolley 1 according to the invention is seen, arranged to move along a main support structure 2 of a crane. The main support 2 here typically comprises a rail whereby the trolley 1 is supported on the lower flange 2*a* of this rail.

The trolley 1 has a support frame structure 3 and bearing wheels 4 which are fastened to it and by means of which the trolley 1 is arranged to move along said main support structure 2. Some of these bearing wheels 4 may be used to move the trolley 1. An actuator (a moving mechanism of the trolley) for driving the bearing wheels 4 is not shown.

Figure 12:
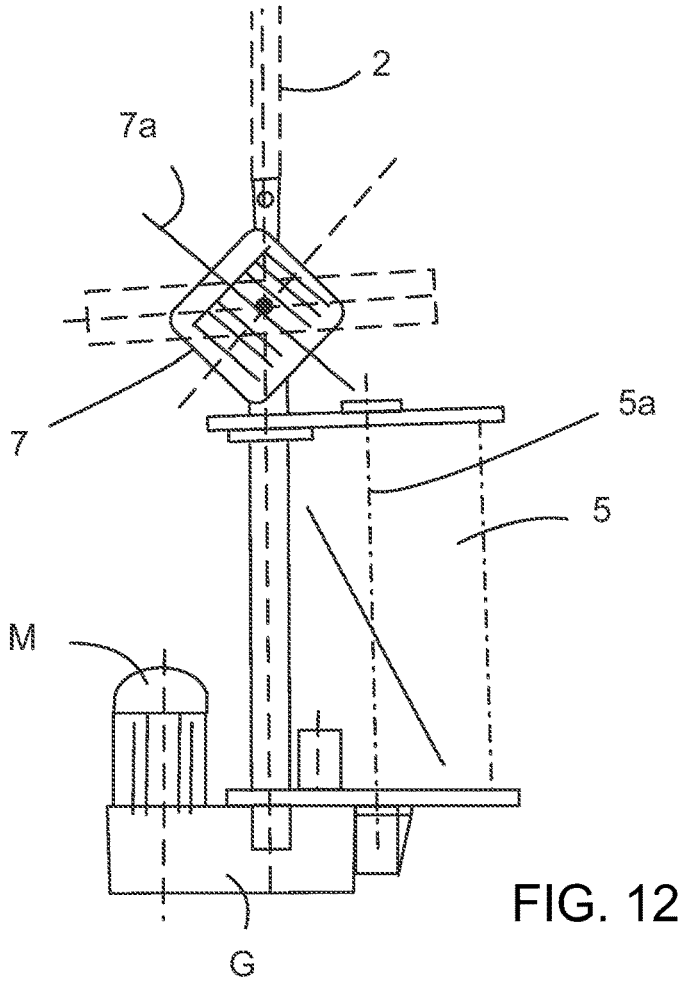
FIG. 12 shows an implementation of the upper rope pulley arrangement.

To the trolley 1, a hoisting mechanism is arranged that has a rope drum 5 for a hoisting rope 6, and a rope pulley arrangement which has upper and lower rope pulley arrangements 7 and 8, through which the hoisting rope 6 may be guided from the rope drum 5 to a fixed fastening point X on the trolley 1. A hoisting member 9 in cooperation with the hoisting rope 6 for hoisting a load is arranged in connection with the lower rope pulley arrangement 8. The rope drum 5 is supported to the support frame structure 3 of the trolley so that the axle 5*a* of the rope drum 5 is parallel to the main support structure 2. A hoisting motor and gears required to operate the hoisting mechanism (rope drum 5) is not shown (but are shown in FIG. 12).

The trolley 1 according to the invention is characterised in that the rope pulley arrangement 7, 8 is located, in the axial direction of the rope drum 5, at least partly outside the rope drum 5 end which is on the side of said fastening point X; and in that the support frame structure 3 is divided into two separate frame parts, that is, a first frame part 3*a* and a second frame part 3*b*, whereby the first frame part 3*a* supports the rope pulley arrangement 7, 8 and the rope drum 5 end on the side thereof, and whereby the second frame part 3*b* supports the opposite end of the rope drum 5. Between the first frame part 3*a* and the second frame part 3*b*, a pivoted joint 16 is arranged, which allows the first 3*a* and second frame part 3*b* to move relative to each other around the vertical and horizontal axis and the longitudinal axis of the first and second frame part.

As FIG. 1 additionally shows (applies to the structure shown in FIGS. 2 and 3), the axles 7*a*, 8*a* of the rope pulley arrangement 7, 8 and the axle 5*a* of the rope drum 5 are at different vertical planes and the rope pulley arrangement 7, 8 is located in the axial direction of the rope drum 5 entirely outside the rope drum 5 end in question. The distance between said vertical planes from each other may advantageously equal one half of the diameter of the rope drum 5. In addition, in this case in which the trolley 1 is one that moves under one rail 2, acting as the main support structure, the disengagement point of the hoisting rope 6 from the rope drum 5, the axles 7*a*, 8*b* of the rope pulley arrangement 7, 8, and the fastening of the hoisting rope 6 to the fixed fastening point X on the trolley 1 are advantageously at essentially the same vertical plane. This vertical plane is adapted to advantageously pass essentially in the direction of the vertical main axis of inertia of the main support 2 and at the plane it defines. In such a case, it is additionally possible to arrange the disengagement point of the hoisting rope 6 from the rope drum 5, the axle 7*a* of the upper rope pulley arrangement 7 adjacent to the rope drum 5, and the fastening of the hoisting rope 6 to the fixed fastening point X on the trolley 1 at essentially the same horizontal plane.

In the solution according to FIGS. 2 and 3, the first frame part 3*a* comprises flange parts 10 disposed on both sides of the rail 2 and to each of which two bearing wheels 4 are fastened, and a transverse connecting rod 11 connecting the lower parts of the flange parts 10, to which connecting rod the frame 12 of the upper rope pulley arrangement 7 is fastened. The second frame part 3*b* comprises flange parts 13 disposed on both sides of the rail 2, to each of which one bearing wheel 4 is fastened, and a transverse connecting rod 14 connecting the lower parts of the flange parts 13, to which connecting rod the "free" end of the frame 15 of the rope drum 5 is fastened. The frame 12 of the upper rope pulley arrangement 7 and the end facing it on the frame 15 of the rope drum 5 are advantageously fastened to each other in a detachable manner.

Figure 5:
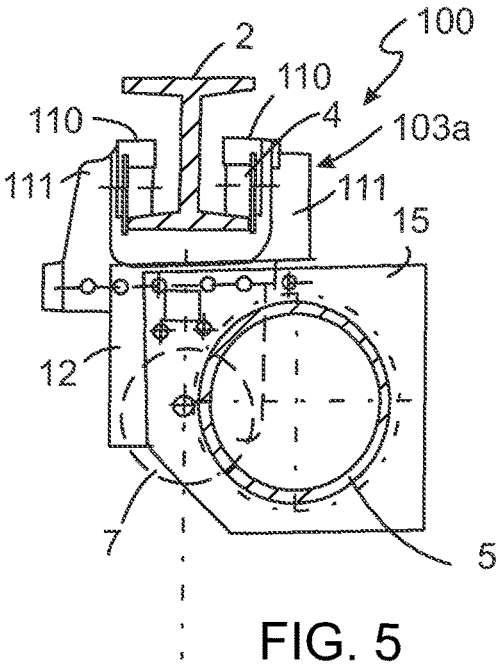
FIG. 5 is a perspective view of the trolley of FIG. 4 seen from the direction of the main support from the section 5-5 of FIG. 4.
Figure 4:
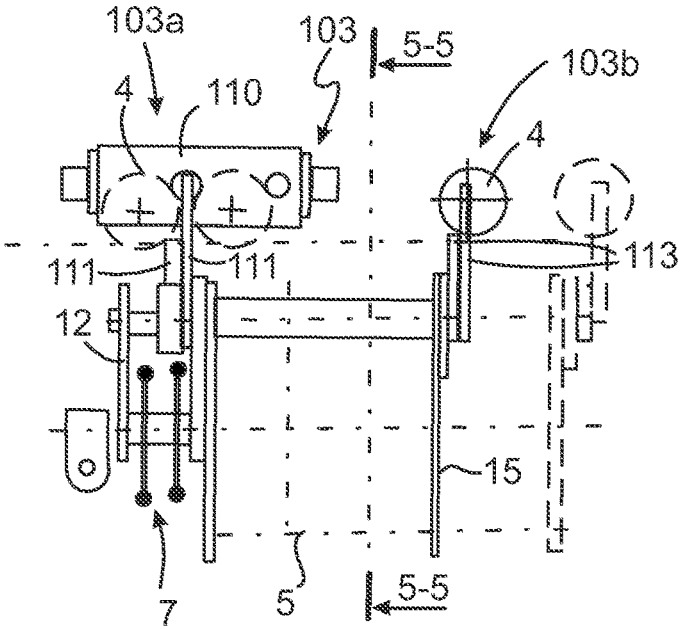
FIG. 4 is a side view of a second trolley according to the invention.

The trolley 100 according to FIGS. 4 and 5 differs from the trolley 1 of FIGS. 2 and 3 only as regards the support frame structure 103, whereby the first frame part 103*a* comprises upside down troughs 110 disposed on both sides of the rail 2, to each of which two bearing wheels 4 are fastened, and a transverse clamp structure 111 connecting the troughs 110 from their sides, to which clamp structure the frame 12 of the upper rope pulley arrangement 7 is fastened. The second frame part 3*b* comprises a clamp structure 113 extending on both sides of the rail 2, to which clamp structure one bearing wheel 4 is fastened on both sides of the rail 2. The "free" end of the frame 15 of the rope drum 5 is fastened to the lower part of this clamp structure 113. The frame 12 of the upper rope pulley arrangement 7 and the end facing it on the frame 15 of the rope drum 5 are advantageously fastened to each other in a detachable manner, as in the case of FIGS. 2 and 3. In connection with FIGS. 4 and 5, the dotted lines illustrate how easy it is to adapt the support frame structure for different lengths of the rope drum 5. The same, of course, applies to the solutions of FIGS. 2 and 3 as well as the solutions described below.

Figure 7:
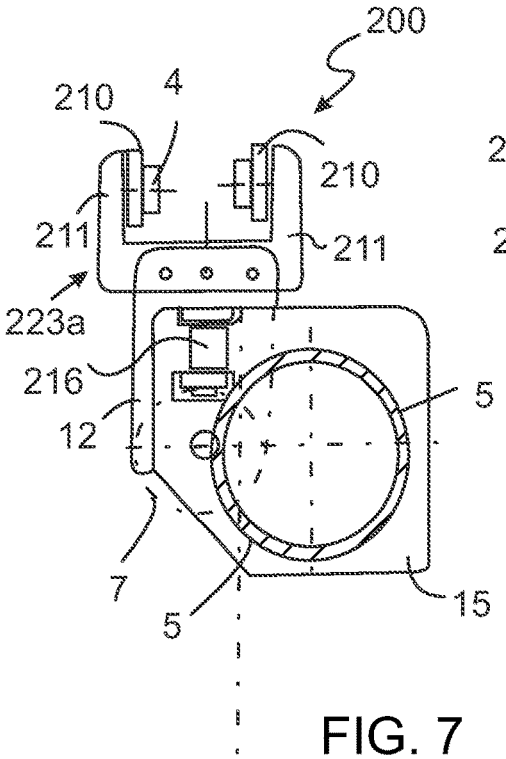
FIG. 7 is a perspective view of the trolley of FIG. 6 seen from the direction of the main support from the section 7-7 of FIG. 6.
Figure 6:
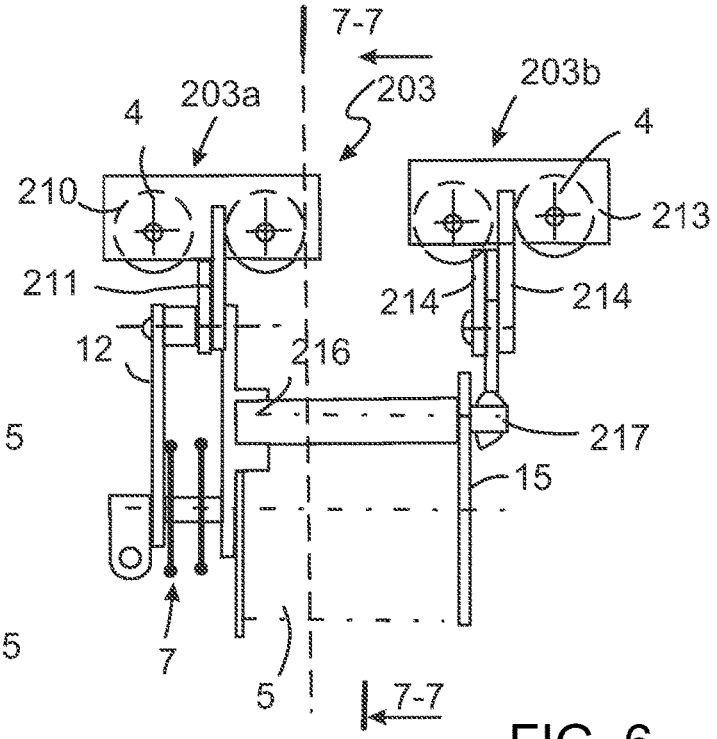
FIG. 6 is a side view of a third trolley according to the invention.
Figure 13:
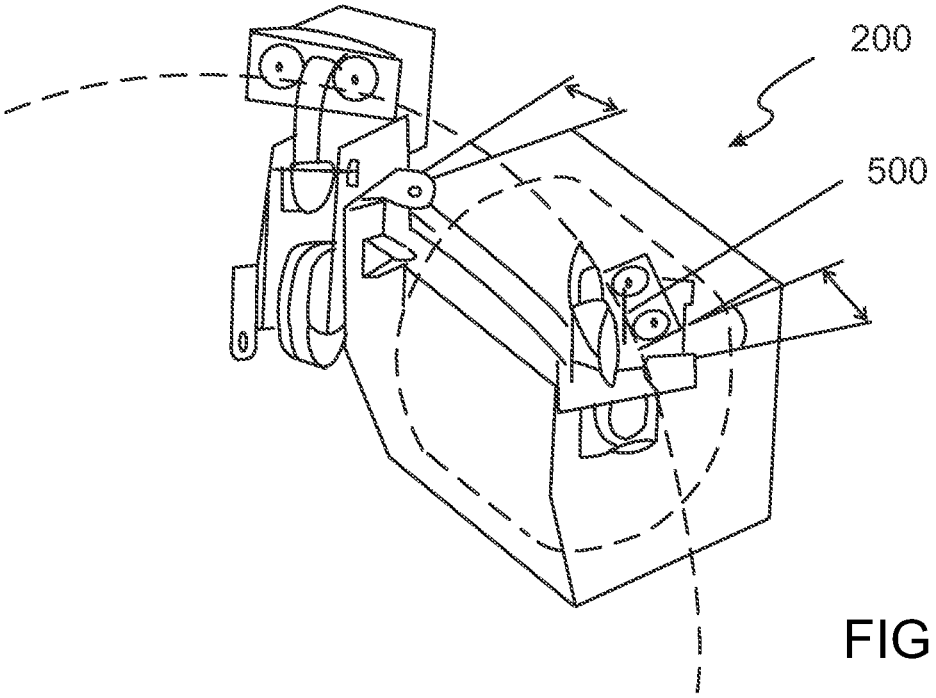
FIG. 13 shows the trolley on a curved track.

The trolley 200 according to FIGS. 6 and 7 in the first place differs from the trolleys in the above Figures as regards the support frame structure 203, whereby the first frame part 203*a* comprises flanges 210 disposed on both sides of the rail 2, to each of which two bearing wheels 4 are fastened, and a transverse clamp structure 211 connecting the flanges 210 from their sides, to which clamp structure the frame 12 of the upper rope pulley arrangement 7 is fastened. The second frame part 203*b* corresponds to the first frame part 203*a* and comprises flanges 213 disposed on both sides of the rail 2 and to each of which two bearing wheels are fastened, and a clamp structure 214 connecting the flanges 213 from their sides. The "free" end of the frame 15 of the rope drum 5 is fastened to the lower part of this clamp structure 214. In addition, the frame 12 of the upper rope pulley arrangement 7 and the end facing it on the frame 15 of the rope drum 5 are fastened to each other with a rotating coupling 216 to allow the mutual rotation of the rope pulley arrangement 7, 8 and the rope drum 5 around a vertical axis. This structure is advantageous when the need arises to drive the trolley on a curved track, in other words, a curved main support structure (see FIG. 13). Further, a rotating coupling 217 is arranged between the second frame part 203*b* and the adjacent "free" end of the frame 15 of the rope drum 5 to allow the mutual rotation of the second frame part 203*b* and the rope drum 5 around a vertical axis. Of these two rotating couplings, the first rotating coupling 216 may be considered more important than the second rotating coupling 217. In FIG. 13, to support the second support frame structure on the bearing wheels 4, a joint 500 allowing rotation around the vertical axis may be adapted, which allows the bearing wheels 4 to turn on a sharply curved main support structure.

Figure 8:
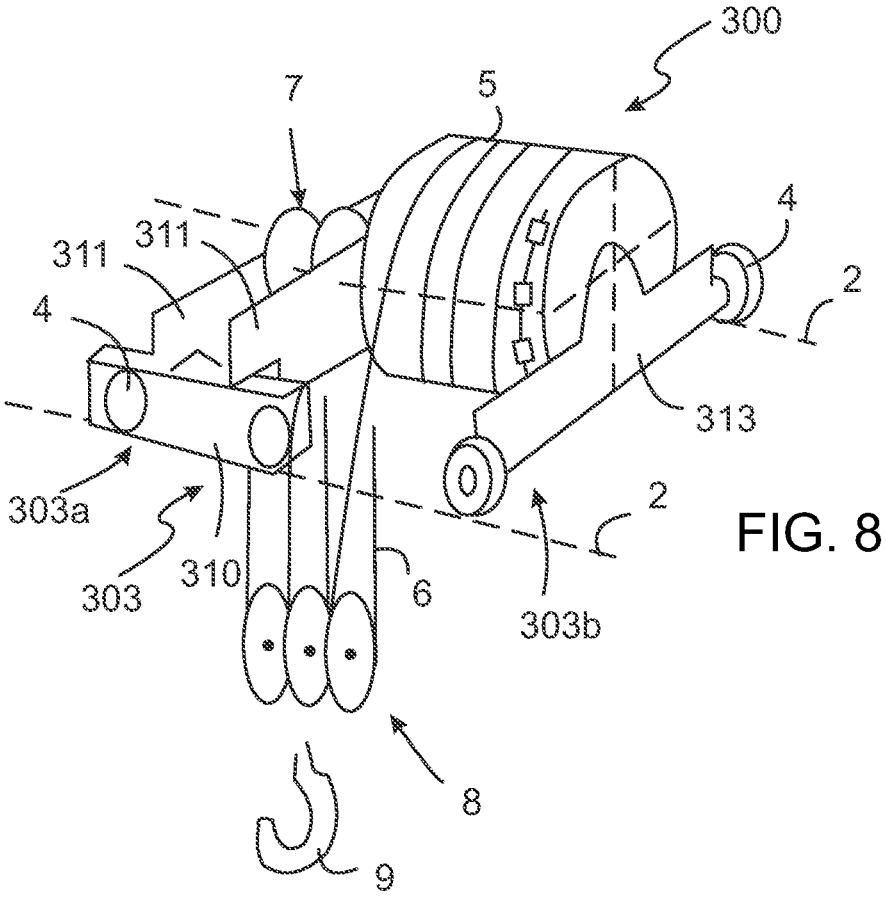
FIG. 8 is a perspective view of a fourth trolley according to the invention.
Figure 9:
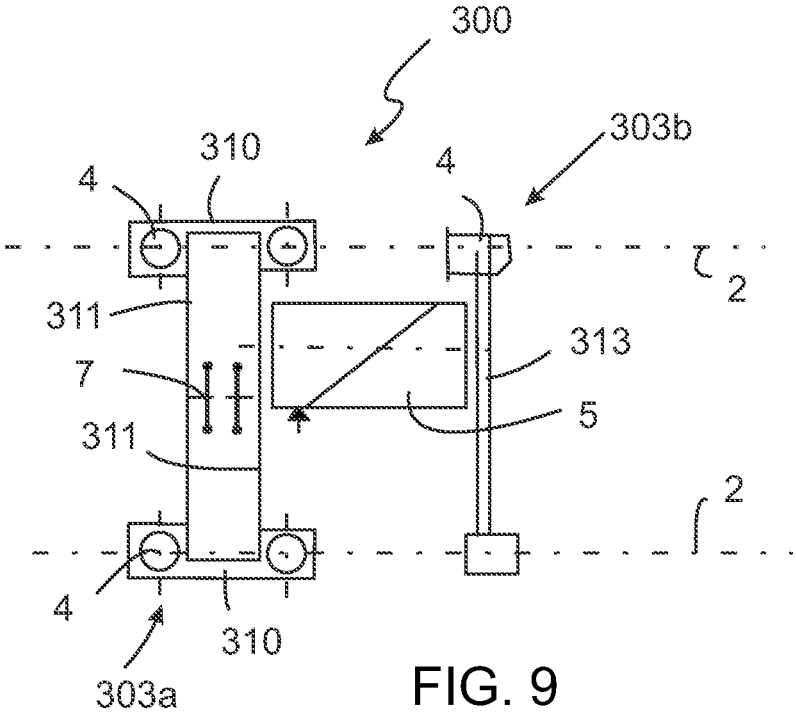
FIG. 9 is a top view of the trolley according to FIG. 8.

FIGS. 8 and 9 show a trolley 300, which moves on two main supports 2, whereby each main support 2 may be formed of a similar rail as in the case of one main support 2. This is in principle simpler than a trolley that moves under a main support 2, because the upper rope pulley arrangement 7 and the rope drum 5 may be placed directly on the support frame structure 303 without separate "intermediate frames". In this trolley 300 put forth, the first frame part 303*a* comprises, at both main supports 2, casings 310 to each of which two bearing wheels 4 are disposed and which are connected with transverse beams 311. The upper rope pulley arrangement 7 is placed between these transverse beams 311. The second frame part 303*b* comprises one transverse beam 313, on both ends of which one rail wheel 4 is disposed at any one time. The first frame part 303*a* and the rope drum 5 end facing it may be rigidly fastened to each other or with a rotating coupling around a vertical axis, like a trolley that moves under the main support 2. In this case, the location of the "power transmission line" on the same vertical plane as the disengagement point of the hoisting rope 6 from the rope drum 5, the rope pulley arrangement 7, 8 and the fixing point of the hoisting rope on the trolley 300 is not, however, as advantageous or necessary as for a trolley that moves under a main support, because the structure of the trolley 300 is load-bearing in any case.

Figure 10:
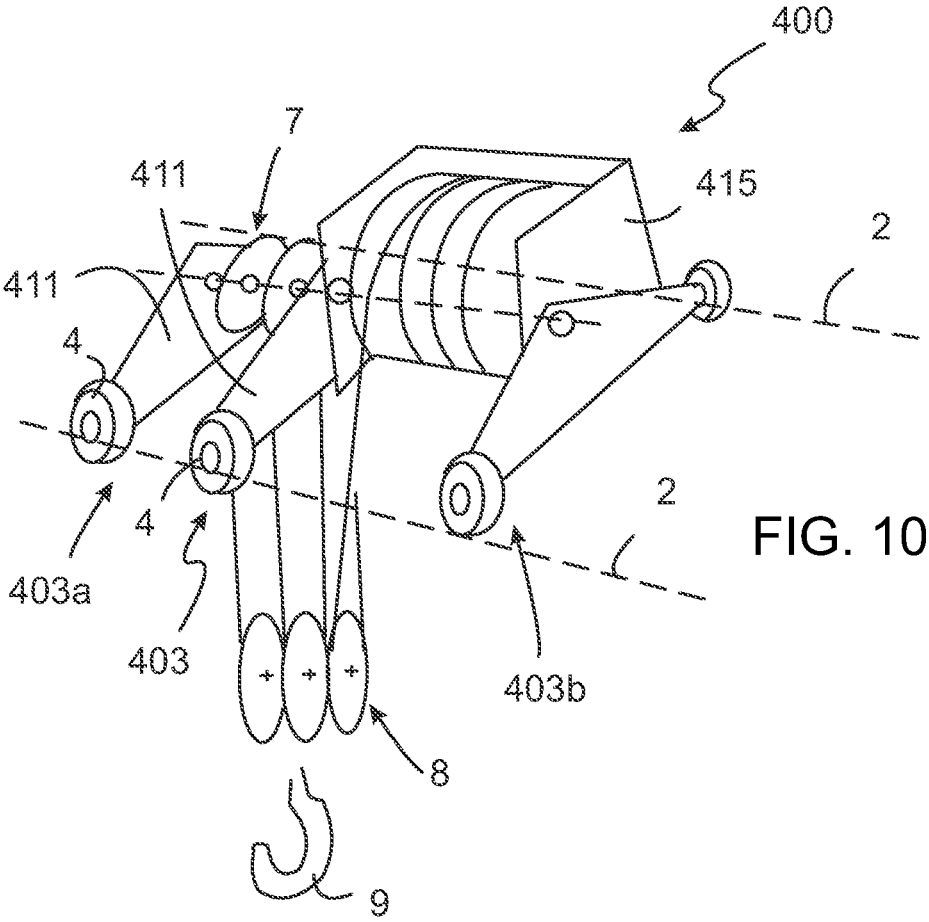
FIG. 10 is a perspective view of a fourth trolley according to the invention.
Figure 11:
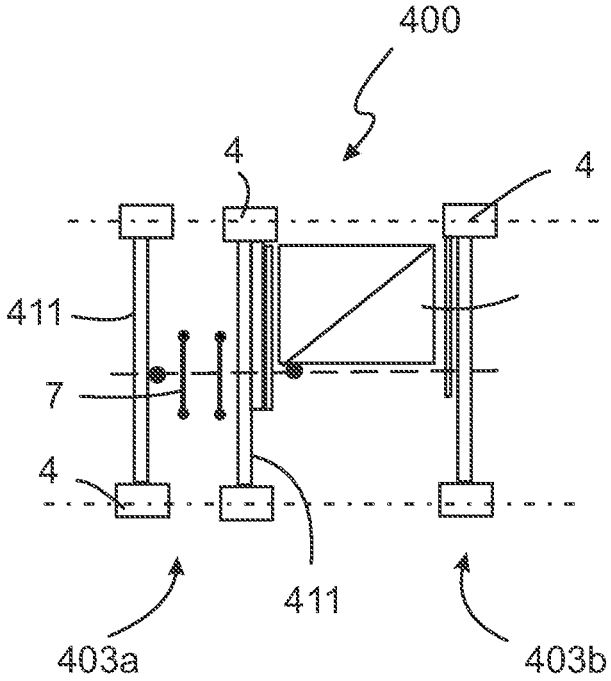
FIG. 11 is a top view of the trolley according to FIG. 10.

Likewise, FIGS. 10 and 11 show a trolley 400 that moves on two main supports 2 and differing from the structure shown in FIGS. 8 and 9 in that the first frame part 403*a* of the support frame structure 403 consists of two transverse beams 411 the ends of which at any one time always have one bearing wheel 4, so in a similar manner as in the second frame part 303*b* in FIGS. 8 and 9. Such a "slice-like" frame structures is simple to adapt on different widths of the upper rope pulley arrangement 7 as well. Here, the rope drum 5 has a dedicated protection or support frame 415 arranged for it.

FIG. 12 shows yet another solution according to the invention as regards the upper rope pulley arrangements 7, whereby this the axle 7*a* of this rope pulley arrangement 7 is slanted in relation to the vertical plane passing through the rope drum 5. Here, the motor M and gears G associated with the hoisting mechanism are also seen.

Figure 14:
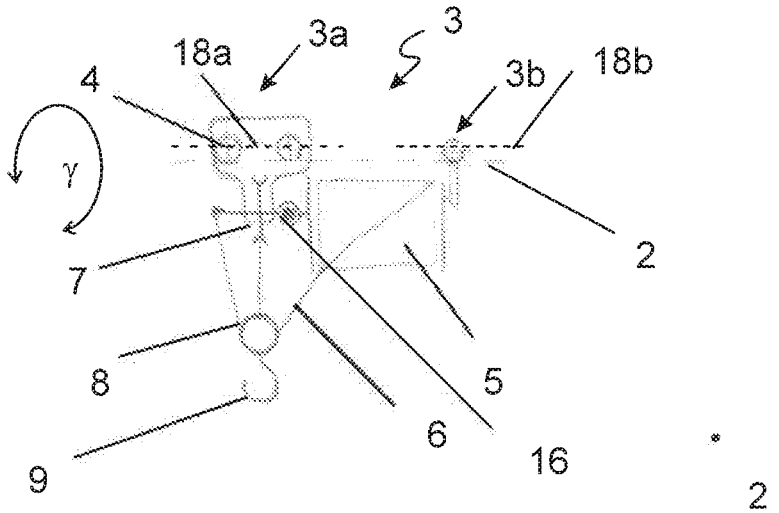
FIG. 14 is a side view of the trolley.
Figure 15:
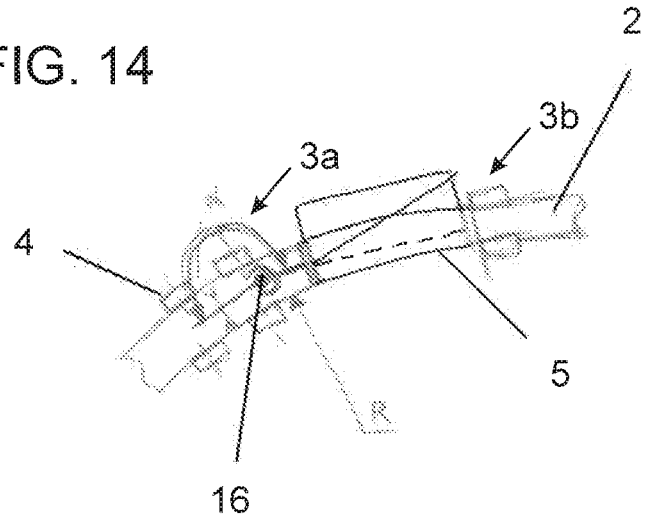
FIG. 15 is a top view of the trolley according to FIG. 14 on a curved main support.
Figure 16:
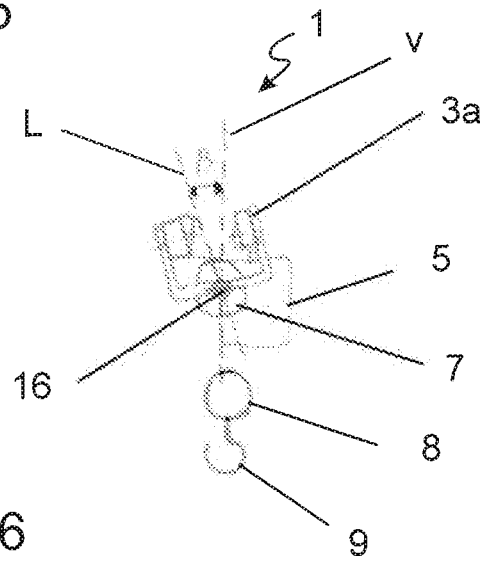
FIG. 16 is shows the trolley of FIG. 14 from the direction of the main support.

FIGS. 14, 15, and 16 show a pivoting solution between two separate frame parts of a trolley of a crane. Between the first frame part 3*a* and the second frame part 3*b*, a pivoted joint 16 is arranged, which allows the first 3*a* and second frame part 3*b* to move relative to each other around the vertical and horizontal axis as well as around the longitudinal axis 18*a-b* of the first 3*a* and second frame part 3*b*.

FIG. 14 is a side view of the trolley 1. The trolley 1 is one that moves under one rail 2, acting as the main support structure. The first frame part 3*a* support the rope pulley arrangement and the rope drum 5 end on its side. The second frame part 3*b* supports the opposite end of the rope drum 5. The pivoted joint 16 allows the relative movement to each other of the first 3*a* and second frame part 3*b* around the horizontal axis at an angle γ. This is advantageous in a situation in which a trolley is run on a main support structure 2 which has vertical deviations. The axle 7 or 7*a* of the upper rope pulley arrangement or the frame of the rope pulley arrangement may form part of the pivoted joint 16. The axle 7*a* may be at the same height position as the pivoted joint 16.

FIG. 15 is a top view of the trolley according to FIG. 14 on a curved track. The pivoted joint 16 is advantageous when the need arises to run the trolley on a curved track, in other words, a curved main support structure 2. The main support structure 2 in FIG. 15 is curved and has a radius of curvature R. FIG. 15 shows the movement around the vertical axis between the first frame part 3*a* and the second frame part 3*b*, made possible by the pivoted joint 16, whereby between the axles of the first frame part 3*a* and second frame part 3*b* an angle α may be established in the horizontal plane. The pivoted joint 16 further allows the bearing wheel to be positioned mutually further away from each other. This results in that the rolling of both frame parts 3*a*, 3*b* is reduced in particular when a hoist is adapted to move supported by a curved main support structure.

FIG. 16 shows the trolley of FIG. 14 from the direction of the main support. FIG. 16 shows the movement, made possible by the pivoted joint 16, around the longitudinal axis 18*a* of the first frame part 3*a*. The first frame part 3*a* is tilted in its longitudinal direction to a side at an angle of tilt β. The angle of tilt β is formed between a plane L in the direction of the longitudinal diameter of the first frame part 3*a* and a vertical plane v. The pivoted joint 16 allows the frame part 3*a* to turn in its direction of travel. This is advantageous, for example, in a situation in which a load on a hoisting member 9 swings in the lateral direction. FIG. 16 shows the angle of tilt β in an exaggerated form for reasons of clarity. When longitudinal turning is allowed between the parts of the support frame structure divided into two parts, in a hoisting situation the contact forces of the bearing wheels become even in a natural manner and the tilting of the support frame structures may be avoided. An even loading on the bearing wheels makes their service life longer and reduces their staggering on the main support. Avoiding staggering and tilting improves the safe operation of the hoist.

Advantageously a torque support for the rope drum 5 is arranged in the second frame part 3*b* when the rope drum 5 is used by means of an electric motor M and gears G.

The pivoted joint 16 advantageously comprises a joint of three degrees of freedom, such as a ball joint. The use of a pivoted joint of three degrees of freedom, such as a ball joint, is also advantageous when the main support is straight. The benefits include the loads becoming even when the support frame structures do not turn in relation to each other.

The pivoted joint between a support frame structure divided into two parts makes it possible that the bearing wheels of the foremost and rearmost support frame structure do not need to be aligned perfectly straight in relation to each other, but they may be moved on the main supports with the principle "tractor and trailer". The alignment work is avoided, and in addition support frame structured straight out of a production line may be used, which are interconnected at the installation site.

In the above embodiment, the rope drum 5 may be installed to an oblique angle from the horizontal, to an angle of approximately 0 . . . 4°, so that the passing of the hoisting rope 6 onto the rope drum 5 or from the rope drum 5 may be better controlled. The pivoted joint having three degrees of freedom facilitates positioning into an oblique angle, because the pivoted joint allows it from the end on the joint side. To implement a desired oblique angle, it is enough to choose a suitable lower height position for the "free" end of the frame 15. Lowering the "free" end of the frame may be carried out by selecting a suitable length for a gripper structure 214. At the end 203*a* of the first frame part of the rope drum 5, the joint 16 allows the rope drum 5 to turn for setting it to an oblique angle.

To form the pivoted joint 16, a suitable material pair is selected for implementing the male-female halves, such as steel-brass. In addition, polymer or injection-moulded plastic are suitable as joining materials. The domed female half is compiled around the male half and fixed by two to four bolted joints, for example. It is furthermore possible to install a grease nipple outside the joint.

In an embodiment for establishing the pivoted joint 16 of three degrees of freedom, the joint need not necessarily be a fully authentic and orthodox ball joint. It is in principle enough that there is a cylindrical opening made in a side plate of the support frame structure, in which a loose pin is installed. The pin may be cylindrical or slightly spherical. The pulling force and pushing force in the longitudinal direction of the frame structures, when a hoist is moving on the main support, may be received and forwarded by means of a chain or strut bar. Forwarding and receiving the pulling force and pushing force may additionally take place through a small longitudinal clearance, which for its part makes possible the use on un-orthodox spherical surfaces.

The above description of the invention is only intended to illustrate the basic idea of the invention. A person skilled in the art may thus vary its details within the scope of the attached claims.

The invention claimed is:

1. A trolley of a crane, arranged to move along a main support structure of the crane, whereby the trolley comprises:

a support frame structure;

bearing wheels which are fastened to the support frame structure and by means of which the trolley is arranged to move along said main support structure; and a hoisting mechanism that has a rope drum for a hoisting rope, a rope pulley arrangement which has upper and lower rope pulley arrangements and through which the hoisting rope may be guided from the rope drum to a fixed fastening point on the trolley, and a hoisting member in cooperation with the hoisting rope for hoisting a load, wherein the rope drum is supported to the support frame structure of the trolley so that the axle of the rope drum is parallel to the main support structure, wherein the rope pulley arrangement is located, in the axial direction of the rope drum, at least partly outside the rope drum end which is on the side of said fastening point;

wherein the support frame structure is divided into two separate frame parts, that is, a first frame part and a second frame part, whereby the first frame part supports the rope pulley arrangement and the rope drum end on the side thereof, and whereby the second frame part supports the opposite end of the rope drum, and wherein between the first frame part and the second frame part, a pivoted joint is arranged, which allows the first and second frame part to move relative to each other around the vertical and horizontal axis and the longitudinal axis of the first and second frame part.

2. The trolley as claimed in claim 1, wherein the pivoted joint is arranged between the upper rope pulley arrangement and the end of the adjacent rope drum to allow the mutual rotation of the rope pulley arrangement and the rope drum.

3. The trolley as claimed in claim 1, wherein the pivoted joint comprises a ball joint.

4. The trolley as claimed in claim 1, wherein the axles of the rope pulley arrangement and the axle of the rope drum are at different vertical planes.

5. The trolley as claimed in claim 4, wherein the distance between said vertical planes from each other essentially equals one half of the diameter of the rope drum.

6. The trolley as claimed in claim 1, wherein the rope pulley arrangement is located, in the axial direction of the rope drum, entirely outside the rope drum end which is on the side of said fastening point.

7. The trolley as claimed in claim 1, wherein the axle of the rope pulley arrangement in the immediate vicinity of the rope drum is slanted in relation to the vertical plane passing through the rope drum.

8. The trolley as claimed claim 1, wherein between the second frame part and the end of the adjacent rope drum, a rotating coupling has been arranged to allow the mutual rotation of second frame part and the rope drum around a vertical axis.

9. The trolley as claimed in claim 1, wherein the trolley is one that moves under one main support, whereby the pivoted joint, the disengagement point of the hoisting rope from the rope drum, at least the axle of the rope pulley arrangement adjacent the rope drum, and the fastening of the hoisting rope to the fixed fastening point on the trolley are at essentially the same vertical plane.

10. The trolley as claimed in claim 9, wherein said vertical plane is adapted to pass essentially in the direction of the vertical main axis of inertia of the main support and at the plane it defines.

11. The trolley as claimed claim 9, wherein the disengagement point of the hoisting rope from the rope drum, the axle of the upper rope pulley arrangement adjacent the rope drum, and the fastening of the hoisting rope to the fixed fastening point on the trolley are at essentially the same horizontal plane.

12. The trolley as claimed in claim 1, wherein the trolley is one that moves on two main supports.

13. The trolley as claimed in claim 1, wherein the axle of the rope drum in at an angle in relation to the horizontal.

* * * * *